US007877034B2

(12) United States Patent
Nakamura et al.

(10) Patent No.: US 7,877,034 B2
(45) Date of Patent: Jan. 25, 2011

(54) IMAGE FORMING APPARATUS, SHEET FINISHER AND IMAGE FORMING SYSTEM

(75) Inventors: Hideki Nakamura, Hachioji (JP); Kazutoshi Yoshimura, Hachioji (JP); Satoshi Sakata, Hino (JP); Kazumichi Yamauchi, Hachioji (JP); Akira Okamoto, Hino (JP); Kenji Yamamoto, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 392 days.

(21) Appl. No.: 12/163,519

(22) Filed: Jun. 27, 2008

(65) Prior Publication Data

US 2009/0016763 A1 Jan. 15, 2009

(30) Foreign Application Priority Data

Jul. 12, 2007 (JP) ..... 2007-183219

(51) Int. Cl.
*G03G 15/00* (2006.01)

(52) U.S. Cl. ..... 399/81; 399/37; 399/74; 399/88; 399/90; 399/407; 399/408; 399/409; 399/410

(58) Field of Classification Search ..... 399/37, 399/74, 81, 88, 90, 407–410
See application file for complete search history.

(56) References Cited

U.S. PATENT DOCUMENTS 4,677,310 A * 6/1987 Midorikawa et al. ..... 307/64
6,567,623 B2 * 5/2003 Kobayashi ..... 399/50
2003/0063918 A1 * 4/2003 Miura ..... 399/90
2004/0151513 A1 * 8/2004 Nomura ..... 399/8
2006/0285867 A1 * 12/2006 Takahashi et al. ..... 399/70

FOREIGN PATENT DOCUMENTS

JP 10-107940 4/1998
JP 10-274913 10/1998

* cited by examiner

*Primary Examiner*—David P Porta
*Assistant Examiner*—Mindy Vu
(74) *Attorney, Agent, or Firm*—Finnegan, Henderson, Farabow, Garrett & Dunner, L.L.P.

(57) ABSTRACT

Disclosed is an image forming apparatus, a sheet finisher and an image forming system; each of them including: a display for displaying a work item for a maintenance in the form of a guidance display; a detection section for detecting whether the work item is executed or not; an energization controller for supplying/blocking power supply to electric components to be maintained; a connection judging section for judging whether the electric components are electrically connected with the power supply or not; and a controller for controlling the display to switch displays of the work item and for controlling the energization controller, in accordance with a detection result of the detection section; wherein the controller causes the display to display an alarm and a guidance display of a corresponding work, according to a judgment of the connection judging section.

6 Claims, 11 Drawing Sheets

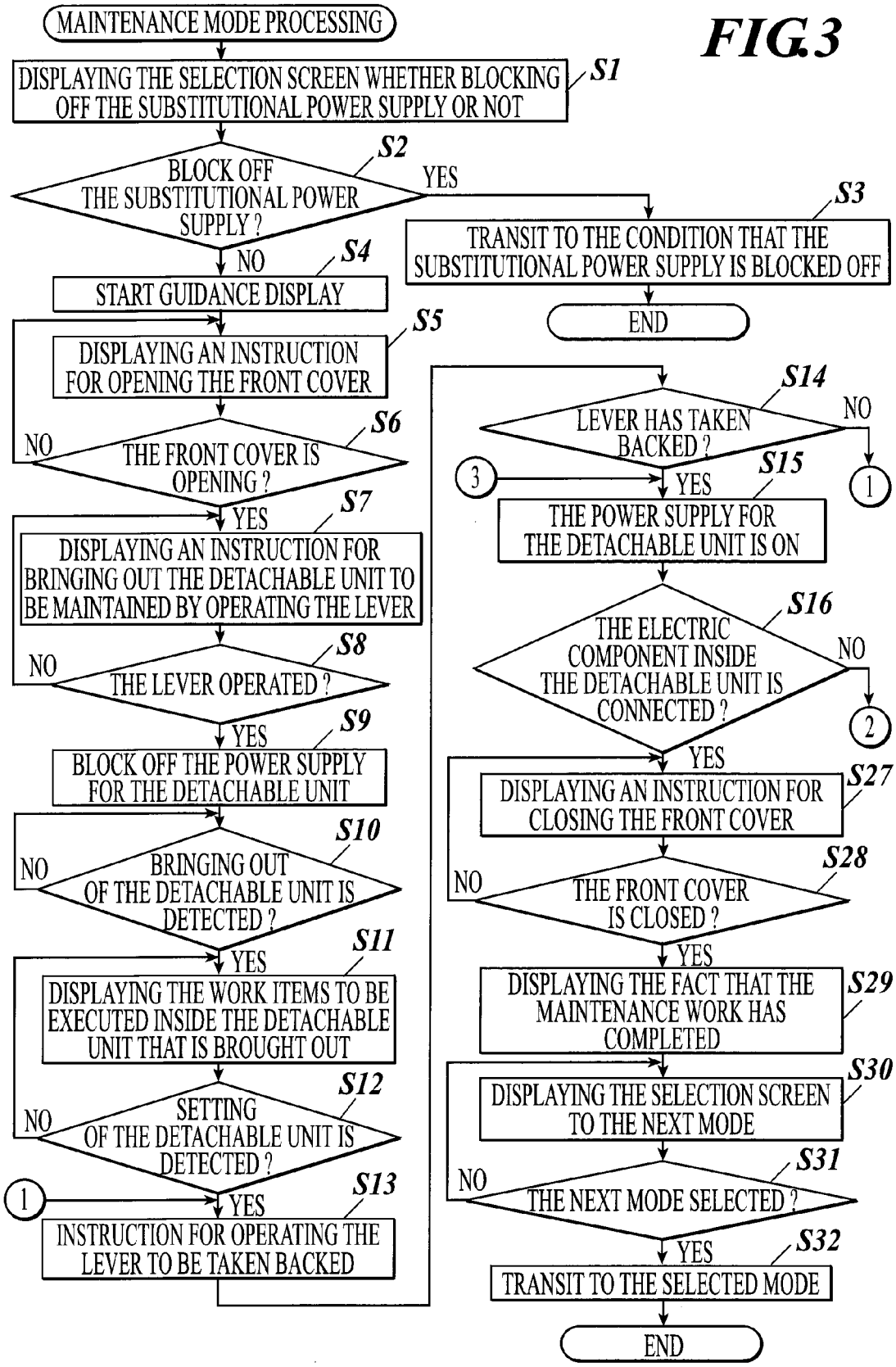
FIG.3
MAINTENANCE MODE PROCESSING
DISPLAYING THE SELECTION SCREEN WHETHER BLOCKING OFF THE SUBSTITUTIONAL POWER SUPPLY OR NOT
S1
BLOCK OFF THE SUBSTITUTIONAL POWER SUPPLY ?
S2
YES
NO
TRANSIT TO THE CONDITION THAT THE SUBSTITUTIONAL POWER SUPPLY IS BLOCKED OFF
S3
END
START GUIDANCE DISPLAY
S4
DISPLAYING AN INSTRUCTION FOR OPENING THE FRONT COVER
S5
THE FRONT COVER IS OPENING ?
S6
NO
YES
DISPLAYING AN INSTRUCTION FOR BRINGING OUT THE DETACHABLE UNIT TO BE MAINTAINED BY OPERATING THE LEVER
S7
THE LEVER OPERATED ?
S8
NO
YES
BLOCK OFF THE POWER SUPPLY FOR THE DETACHABLE UNIT
S9
BRINGING OUT OF THE DETACHABLE UNIT IS DETECTED ?
S10
NO
YES
DISPLAYING THE WORK ITEMS TO BE EXECUTED INSIDE THE DETACHABLE UNIT THAT IS BROUGHT OUT
S11
SETTING OF THE DETACHABLE UNIT IS DETECTED ?
S12
NO
1
YES
INSTRUCTION FOR OPERATING THE LEVER TO BE TAKEN BACKED
S13
LEVER HAS TAKEN BACKED ?
S14
NO
3
YES
1
THE POWER SUPPLY FOR THE DETACHABLE UNIT IS ON
S15
THE ELECTRIC COMPONENT INSIDE THE DETACHABLE UNIT IS CONNECTED ?
S16
NO
2
YES
DISPLAYING AN INSTRUCTION FOR CLOSING THE FRONT COVER
S27
THE FRONT COVER IS CLOSED ?
S28
NO
YES
DISPLAYING THE FACT THAT THE MAINTENANCE WORK HAS COMPLETED
S29
DISPLAYING THE SELECTION SCREEN TO THE NEXT MODE
S30
THE NEXT MODE SELECTED ?
S31
NO
YES
TRANSIT TO THE SELECTED MODE
S32
END

IMAGE FORMING APPARATUS, SHEET FINISHER AND IMAGE FORMING SYSTEM

BACKGROUND OF THE INVENTION

1. Field of the Invention

The present invention relates to an image forming apparatus, a sheet finisher and an image forming system.

2. Related Art

Heretofore, an image forming apparatus and a sheet finisher has been devised in order that a user may personally handle a light maintenance such as a jam disposal or an exchange of the toner bottle or the like. In general, a front covers that can be opened/closed by the user is arranged on a housing of the image forming apparatus or the like, and a limited mechanical part of such as the image forming apparatus can be exposed by opening the front covers.

However, although a part that is exposed when the front covers are opened is only a limited mechanical part, safeness of an operator is to be ensured.

Consequently, most of the image forming apparatus or the like has an interlock function, which turns on/off according to an opening/closing of the front covers of the housing. The interlock function functions so as to mechanically turn on/off a power line to a driving motor or the like mounted in the image forming apparatus.

A technique for displaying guidance, which shows work sequence, on an operation display or the like to assist users is known too, though it is not directly ensure the safeness of an operator (see Japanese Patent Application Laid-Open Publication No. 10-107940).

Meanwhile, in the case of complicated and advanced maintenance that requires serviceman, turning off a main power supply is postulated. Therefore the motion of the image forming apparatus (or the sheet finisher) is lead to be stopped in its entirety. As for such maintenance items, for example, there are items for exchanging carriers of developer, exchanging rollers arranged in a paper path, exchanging consumable parts such as clutches, a cleaning or the like. As for a specific example of the maintenance work, a unit to be maintained is firstly brought out from the image forming apparatus; some parts are exchanged; or a cleaning or the like is executed; after a disassembly operation such as taking off screws from predetermined spots; taking off wirings and so on. Then, reverse procedure to the disassembly operation is executed to execute assembly operation to reset the unit to be maintained onto the image forming apparatus.

For the purpose of improving a working efficiency and ensuring safeness of a serviceman, an image forming apparatus that is intended to improve a working efficiency and safeness by detecting release of a fixed unit so as to shut off a corresponding power supply is proposed (see Japanese Patent Application Laid-Open Publication No. 10-274913).

SUMMARY OF THE INVENTION

The present invention was made in view of the problem mentioned above.

According to a first aspect of the present invention, there is provided an image forming apparatus, including: a display for displaying a work item for a maintenance in the form of a guidance display; a detection section for detecting whether the work item currently displayed on the display is executed or not; an energization controller for supplying/blocking power supply to a first electric component to be maintained and/or to a second electric component being located adjacent to the first electric component; a connection judging section for judging whether the first/second electric components are electrically connected with the power supply or not; and a controller for controlling the display to switch displays of the work item and for controlling the energization controller to switch supplying/blocking power supply to the first/second electric component in accordance with a detection result of the detection section; wherein the controller causes the display to display an alarm and a guidance display of a corresponding work, when the connection judging section judges the electric components not being electrically connected with the power supply, when the power supply is resumed after blocking the power supply to the first/second electric component by the energization controller.

Preferably, each of the first/second electric component is unitized, and the unit is detachably attached to a housing of the image forming apparatus, to another unit, or to the electric component through a connection section.

According to a second aspect of the present invention, there is provided a sheet finisher including: a display for displaying a work item for a maintenance in the form of a guidance display; a detection section for detecting whether the work item currently displayed on the display is executed or not; an energization controller for supplying/blocking power supply to a first electric component to be maintained and/or to a second electric component being located adjacent to the first electric component; a connection judging section for judging whether the first/second electric components are electrically connected with the power supply or not; and a controller for controlling the display to switch displays of the work item and for controlling the energization controller to switch supplying/blocking power supply to the first/second electric component in accordance with a detection result of the detection section; wherein the controller causes the display to display an alarm and a guidance display of a corresponding work, when the connection judging section judges the electric components not being electrically connected with the power supply, when the power supply is resumed after blocking the power supply to the first/second electric component by the energization controller.

Preferably, each of the first/second electric components is unitized, and the unit is detachably attached to a housing of the sheet finisher, to another unit, or to the electric component through a connection section.

According to a third aspect of the present invention, there is provided an image forming system having an image forming apparatus and a sheet finisher, the system including: a display for displaying a work item for a maintenance in the form of a guidance display; a detection section for detecting whether the work item currently displayed on the display is executed or not; an energization controller for supplying/blocking power supply to a first electric component to be maintained and/or to a second electric component being located adjacent to the first electric component; a connection judging section for judging whether the first/second electric components are electrically connected with the power supply or not; and a controller for controlling the display to switch displays of the work item and for controlling the energization controller to switch supplying/blocking power supply to the first/second electric component in accordance with a detection result of the detection section; wherein the controller causes the display to display an alarm and a guidance display of a corresponding work, when the connection judging section judges the electric components not being electrically connected with the power supply, when the power supply is resumed after blocking the power supply to the first/second electric component by the energization controller.

Preferably, each of the first/second electric components is unitized, and the unit is detachably attached to a housing of the image forming system, to another unit, or to the electric component through a connection section.

BRIEF DESCRIPTION OF THE DRAWINGS

The above and other objects, advantage and features of the present invention will become more fully understood from the detailed description given hereinbelow and the appended drawings which are given by way of illustration only, and thus are not intended as a definition of the limits of the present invention, and wherein:

FIG. 3 is a flowchart showing maintenance mode processing executed by a controller shown in FIG. 2;

DETAILED DESCRIPTION OF THE PREFERRED EMBODIMENTS

In the following, a first embodiment of the present invention will be described with reference to the attached drawings.

The first embodiment shows an example of the present invention applied to an image forming apparatus 1.

First of all, a construction of the image forming apparatus 1 will be explained.

Figure 1:
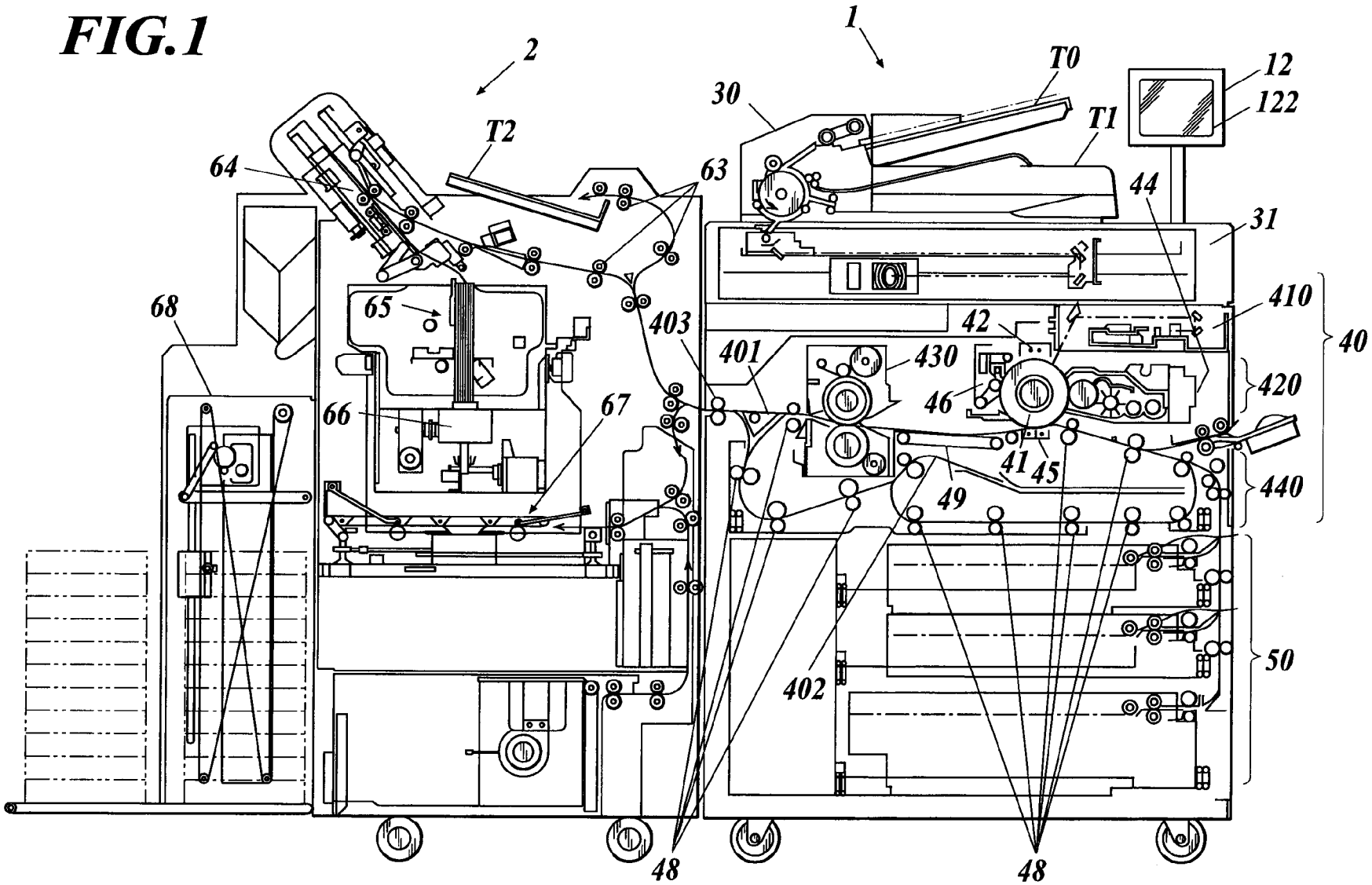
FIG. 1 is a schematic view showing a mechanical construction of an image forming apparatus and a sheet finisher of a first embodiment of the present invention.

FIG. 1 shows a mechanical construction of the image forming apparatus 1 and a sheet finisher 2 connected thereof shown by a schematic view.

The image forming apparatus 1 has an operating section 12, an Auto Document Feeder (ADF) 30, an image reading section 31, a printer 40, and a paper feeder 50.

The operating section 12 has a Liquid Crystal Display (LCD) 122 as a display of the present embodiment. The LCD 122 displays various operation input screens, condition of the apparatus, and operating conditions of various functions.

The ADF 30 is openable and closeable attached at the top of the image reading section 31. The ADF 30 auto feeds original manuscripts that are loaded on a tray T0 for an original manuscript one by one to an original manuscript reading position on a platen glass of the image reading section 31. Then, after image reading at the image reading section 31, the ADF 30 discharges the manuscript to a tray T1 for discharged sheet.

The image reading section 31 includes a platen glass, a light source, and a Charge Coupled Device (CCD) and so on. The image reading section 31 reads an image of the original manuscript by forming and photoelectrically with converting an image of a reflected light that is illuminating scanned from the light source to the original manuscript. Then, the image reading section 31 converts the read image into digital image data by an A/D converter. Here, the image includes not only an image data of graphics or photos but also a text data or the like such as characters or marks or the like.

The printer 40 forms an image corresponding to the image data onto a sheet by an electrophotographic process. The printer 40 includes a laser section 410, an image forming section 420, an anchorage section 430, a conveyer section 440 and so on.

The laser section 410 forms an electrostatic latent image, according to the input image data, by irradiating laser light to a surface of a photoreceptor drum 41 that is electrically charged by an electric charger 42 of the image forming section 420.

The image forming section 420 includes a photoreceptor drum 41 as an image carrier, an electric charger 42 for electrically charging the surface of the photoreceptor drum 41 at a predetermined charge amount, a developing equipment 44 for providing developer (toner) to the electrostatic latent image that is formed on the surface of the photoreceptor 41 to develop, a transcriber 45 for transcribing the toner image formed on the photoreceptor drum 41 to a sheet fed by the paper feeder 50, a cleaning section 46 for cleaning up residual toner on the surface of the photoreceptor drum 41 and so on.

The anchorage section 430 anchorages, by heating, the toner image on the sheet formed at the image forming section 420.

The conveyer section 440 includes a conveying roller 48, a conveyer belt 49, a paper path switching board 401, a reversible conveying unit 402, a discharging roller 403 and so on. The conveyer section 440 conveys the sheet fed from the paper feeder 50, in order to discharges the sheet to the sheet finisher 2 through the image forming section 420 and the anchorage section 430.

Figure 2:
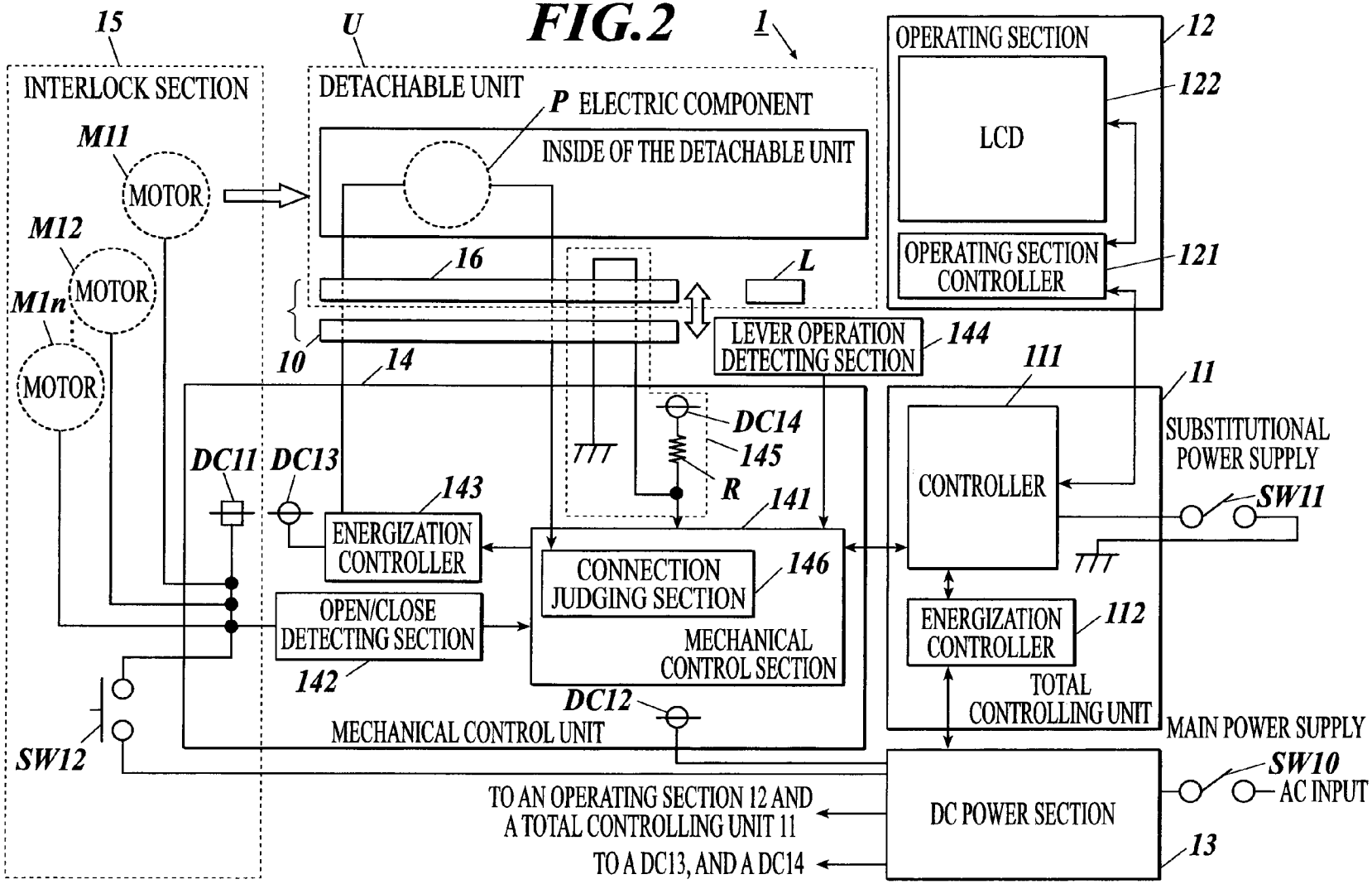
FIG. 2 is a block diagram showing a construction of a control system of the image forming apparatus shown in FIG. 1.
Figure 4:
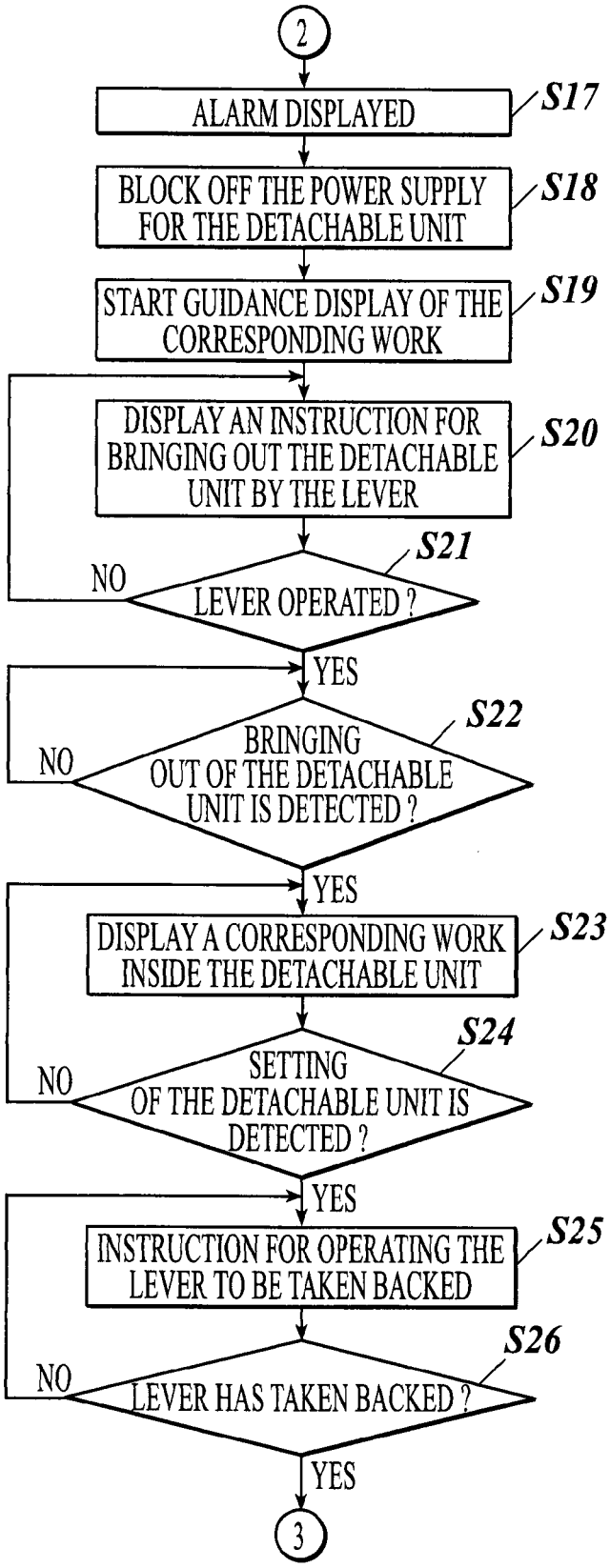
FIG. 4 is a flowchart showing maintenance mode processing executed by a controller shown in FIG. 2.

Here, the printer 40 includes one or a plurality of the detachable unit(s) U, which is (are) detachably attached to the printer 40 (see FIG. 2). The detachable unit U is an assembly, each configured by putting one or a plurality of parts or members together, respectively. For example, the detachable unit U is such as an image forming unit that is formed by assembling each parts or members, which is to form the image forming section 420, an Automatic Duplex Copy Unit (ADU unit) that is formed by assembling each parts or members, which is to form the anchorage section 430 and the conveyer section 440. The detachable unit U is detachably attached to a housing of the image forming apparatus 1, to another detachable unit U, or to another parts or members, through a connection section (for example, a combination of connection sections 10 and 16 shown in FIG. 2). Incidentally, the word "detachable unit U" is generalized in FIG. 2 to simplify the explanation, though the image forming apparatus 1 has one or a plurality of detachable unit(s) U.

The paper feeder 50 includes trays for storing papers, on which an image is to be transcribed. In the present embodiment, the paper feeder 50 includes three trays i.e. an upper tray, a middle tray, and a lower tray.

The sheet finisher 2 has a case binding function, and the sheet finisher 2 includes a conveyer section 63, a sub compiler 64, a clump section 65, starching section 66, square back forming section 67, brochure housing section 68 and so on.

The conveyer section 63 conveys a paper, which is fed from the image forming apparatus 1, to a discharge tray T2, to the sub compiler 64, or to the square back forming section 67.

The sub compiler 64 stacks papers, on which the image is formed, the paper being conveyed from the image forming apparatus 1, as a partial stack of papers.

The clump section 65 obtains papers stacked at the sub compiler 64 so as to pile up the papers, and executes clump (secure) processing when the number of the papers reaches predetermined number of papers.

The starching section 66 is arranged in a back side of the sheet finisher 2. Then, in a paste applying process, the starching section 66 moves forward, and applies paste to an under side of the stack of papers, to which the clump process is executed, when the starching section 66 moves backward.

The square back forming section 67 is arranged beneath the clump section 65, moves upwards with mounting paper as a cover sheet that is fed from the image forming apparatus 1, paste up the cover sheet to the under side of the stack of papers, on which the paste is applied, and form a square back on the cover sheet that is applied to the stack of papers. Then, the square back forming section 67 conveys a formed brochure to the brochure housing section 68.

The brochure housing section 68 mounts an accomplished brochure.

Incidentally, although the sheet finisher 2 in the above described embodiment has a case binding function as an example, the sheet finisher may have functions such as a hole punching function, a saddle stitch binding function, a folding function and so on.

Next, an example of a construction of a control system of the image forming apparatus 1 according to the first embodiment will be described with reference to the FIG. 2.

The control system of the image forming apparatus 1 includes a connection section 10, a total controlling unit 11, an operating section 12, a DC power section 13, a mechanical control unit 14, and an interlock section 15.

The connection section 13 electrically connects the detachable unit U to the mechanical control unit 14. Here, a connection structure of the detachable unit U and the mechanical control unit 14 will be described. Incidentally, although the connection section will be explained with being assumed to be fixed to the housing of the image forming apparatus 1, the connection section may be fixed to some part other than the housing, or there may be a form such as a connector not being connected to predetermined spot.

The detachable unit U has a connection section 16. The connection section 16 is arranged in a position where the connection section 16 can be engaged with the connection section 10 on the housing of the image forming apparatus 1. The connection section 16 has a plurality of pins, through which the connection section 16 transmits various signals and supply electric power from an electric source between an electric component P and a mechanical control section 141 or an energization controller 143 of the mechanical control unit 14. The detachable unit U is configured to that the engagement between the connection sections 10 and 16 is cleaved at a time when the detachable unit U is brought out from the image forming apparatus 1, then at the same time, the electric power supply from the electric source is stopped. Meanwhile, the connection section 10 is engaged with the connection section 16 by pushing back the detachable unit U into the image forming apparatus 1. The detachable unit U can, then, transmit signals between the electric component P, and can supply an electric power to the electric component P. Incidentally, although one or a plurality of the electric component(s) is (are) arranged in the detachable unit U, the electric components are generalized in FIG. 2 as the electric component P to simplify the explanation.

Moreover, the detachable unit U has a lever L for fixing the detachable unit U to the housing of the image forming apparatus 1. The lever L fixes the detachable unit U, being held up, to the housing of the image forming apparatus 1, and unlocks the fixing state when rotationally being operated at a predetermined angle from the fixing state.

The total controlling unit 11 includes a controller 111 and an energization controller 112.

The controller 111 includes a Central Processing Unit (CPU), a Read Only Memory (ROM), a Random Access Memory (RAM) and so on. The CPU of the controller 111 read out a system program or various processing programs, which are stored in the ROM, in accordance with an operation of the operating section 12, so as to expand the programs into the RAM, and centrally controls behaviors of several parts of the image forming apparatus 1 in accordance with the expanded programs.

For example, if a transition instruction to a maintenance mode is input from the operation section 12, the controller 11 reads out a maintenance mode processing program that is stored in the ROM so as to execute a maintenance mode processing described below.

Moreover, the CPU of the controller 111 is connected to a switch SW11 of a substitutional power supply. If the switch SW11 is operated, and an operation signal indicating that the substitutional power supply is turned ON is input, the CPU of the controller 111 instructs a DC power section 13 to supply an electric power to each of the electric components P through the energization controller 112. If the operation signal indicating that the substitutional power supply is turned OFF is input, the CPU of the controller 111 instructs the DC power section 13 to block off the electric power supply to each of the electric components P.

Incidentally, an ON/OFF shift of the substitutional power supply can be switched over by an input switch displayed on the LCD 122, other than the operation of the switch SW11.

The operation section 12 includes an operation section controller 121 and an LCD 122 as a display.

The operation section controller 121 includes a CPU, a ROM, a RAM and soon. Then, the operation section controller 121 controls displaying of the LCD 122 according to a control signal that is received from the controller 111. Moreover, the operation section controller 121 outputs an operation signal input from a touch panel on the LCD 122 to the controller 111.

The LCD 122 displays various operation screens, a condition of an image, behavior condition of various functions and so on. The screen of the LCD 122 has a pressure-sensitive (resistive) touch panel that is built by arranging transmissive electrode in a reticular pattern. The LCD 122 detects an X-Y coordinate of a point, on which the touch panel is pressed by a finger or a touch pen or the like, as a voltage value, and outputs a detected position signal as an operation signal to the operation section controller 121.

The operation section 12 further includes various operating buttons (not shown) such as numeric buttons or a start button, and outputs an operating signal from the operation section controller 121 to the controller 111, according to an operation of the buttons.

The DC power section 13 is connected to a commercial alternating-current (AC) source. The DC power section 13 converts an AC power, which is supplied from the AC source, to a direct-current (DC) power, so as to apply a voltage needed to respective parts (e.g. the total controlling unit 11, the operation section 12, the mechanical control unit 14 and so on).

Specifically, the DC power from the DC power section 13 is supplied to a power source DC11 through an interlock switch SW12, so as to be supplied, by the power source DC11, to motors M11-M1*n* of an interlock section 15. Moreover, the DC power from the DC power section 13 is supplied to a power source DC12, so as to be supplied, by the power source DC12, to respective parts of the mechanical control unit 14. Moreover, the DC power from the DC power section 13 is supplied to the total controlling section 11, the operation section 12 and the power sources DC13 and DC14.

The DC power section 13 supplies an electric power to the above-described respective parts, according to a control instruction from the energization controller 112. A connection between the DC power section 13 and the commercial AC source can be changed ON/OFF by changing the main power supply SW10.

The mechanical control unit 14 includes the mechanical control section 141, an open/close detecting section 142, an energization controller 143, a lever operation detecting section 144, an attach/detach detection section 145, and the power sources DC11-DC14.

The mechanical control section 141 includes a CPU, a ROM, a RAM, or the like, and receives control signal from the control section 11 so as to control respective parts, which construct the printer 40.

Moreover, the mechanical control section 141 is connected to the open/close detecting section 142, the lever operation detecting section 144, and the attach/detach detecting section 145. Then, the mechanical control section 141 outputs detecting signal input from these detecting sections 142, 144, and 145 to the controller 111.

Moreover, the mechanical control section 141 is connected to the energization controller 143. Then, the mechanical control section 141 outputs, to the energization controller 143, an instruction for supplying an electric power or an instruction for blocking off the electric power supply.

Furthermore, the mechanical control section 141 has a connection judging section 146. The connection judging section 146 monitors, through the connection section 10, whether a signal from the electric components P of the detachable unit U is input or not. Then, the connection judging section 146 judges whether the electric components P are electrically connected with the power source DC13, according to the existence of a signal input from the electric components P, so as to output a signal that indicates a result of the judgment.

The open/close detecting section 142 is connected to a connection spot between the interlock switch SW12 and the power source DC11. The open/close detecting section 142 detects an ON/OFF of the interlock switch SW12 according to a signal input from the connection spot, so as to output a signal indicating a detection result.

The energization controller 143 can be connected with the electric components P through the connection section 10. Then, if an instruction for supplying an electric power to the electric components P, the energization controller 143 supplies DC power from the power source DC13 to the electric components P through the connection section 10. Moreover, if an instruction for blocking off the electric power to the electric components P is input from the mechanical control section 141, the energization controller 143 blocks off the electric power supply to the electric components P.

The lever operation detecting section 144 detects a rotating operation of the lever L of the detachable unit U, so as to output a signal, which indicates the execution of the rotating operation, to the mechanical control section 141.

The attach/detach detecting section 145 monitors an engaging condition between the connection sections 10 and 16. Then, if the connection sections 10 and 16 are connected with each other, a resistor R and the ground is electrically connected with each other that arises a signal change from, for example, high level to low level in logic level. Then, the attach/detach detecting section 145 outputs the signal change as a detection signal to the mechanical control section 141.

The interlock section 15 has the interlock switch SW12, and the interlock section 15 switches ON/OFF the power line to driving sources such as the motors M11-M1*n*, according to an opening/closing of a front covers (not shown) arranged on a front surface of the image forming apparatus 1. Specifically, the interlock switch SW12 is held down when the front covers are closed, that causes the interlock switch SW12 to switch ON the power line to the driving sources such as the motors M11-M1*n* arranged in several points of the printer 40 to drive each parts thereof. When the front covers are opened, the interlock switch SW12 is released, that causes the interlock switch SW12 to switch OFF the power line.

Next, the movement of the image forming apparatus 1 will be described.

FIG. 3 shows a flowchart showing maintenance mode processing executed by a controller 111 shown in FIG. 2. This processing is executed by a software process according to a cooperation of the CPU of the controller 111 and the maintenance mode processing program stored in the ROM of the controller 111, when a kind of maintenance is selected and a transition instruction to the maintenance mode is input through the operation section 12.

First of all, a selection screen for selecting whether the substitutional power supply is to be switched OFF or not is displayed on the LCD 122 (step S1). Then, when a switch that causes the substitutional power supply to be blocked off is selected by a user (step S2: YES), the processing is finished with the power supply from the DC power section 13 to each of the parts being blocked off by the energization controller 112, and the condition of the substitutional power supply is transited to be blocked off (step S3).

In step S2, when a switch that causes the substitutional power supply to be blocked off is not selected by the user through the selection screen displayed on the LCD 122 (step S2: NO), the LCD 122 starts displaying a guidance display of some kind of work items that is selected, when the image forming apparatus 1 is transmitted to the maintenance mode, by the user through the operation section 12 (step S4). Here, a display data (image data) for guidance displaying, with respect to each kinds of maintenance, a set of work items of maintenance is stored in the ROM of the controller 111. The guidance display is displayed with the display data stored in the ROM of the controller 111 being read out by the CPU.

In the guidance display, an instruction that indicates to open the front covers is firstly displayed (step S5). Then, whether the front cover is opened or not is judged (by a judging section), according to the detection result, which indicates whether the detection signal that indicates the interlock switch SW12 being switched to OFF from the open/close detecting section 142 is input through the mechanical control section 141 or not (step S6). If the judging section judges the front covers are not in an opened condition (step S6: NO), the processing transits back to the step S5. If the judging section judges the front covers are in an opened condition (step S6: YES), the processing transits to step S7.

In step S7, the CPU of the controller 111 changes the guidance display, which is displayed in the LCD 122, to display an instruction to operate the lever L so as to bring out the detachable unit U including parts or members to be maintained (step S7). In the following description of the flowchart shown in FIG. 3, the detachable unit U includes the parts or members to be maintained, and the lever L means lever L, which fixes the detachable unit U to the image forming apparatus 1, or releases the detachable unit U from the image forming apparatus 1.

Next, the CPU of the controller 111 judges whether the lever L is operated or not, according to whether the detecting signal indicating an execution of the rotating operation of the lever L is input from the lever operation detecting section 144 through the mechanical control section 141 or not (step S8). If the CPU judges that the lever L is not operated (step S8: NO), the processing transits back to the step S7. If the CPU judges that the lever L is operated (step S8: YES), the instruction to block off the power supply to the electric components P of the detachable unit U is input to the energization controller 143 through the mechanical control section 141. Then, the power supply to the electric components P is blocked off by the energization controller 143 (step S9). Here, the power supply to the (first) electric components to be maintained or a (second) electric components adjacent to the first electric components is blocked off, by blocking off the power supply to the electric components P of the detachable unit U by the energization controller 143. Then, according to the detecting signal input from the attach/detach detecting section 145 through the mechanical control section 141, the CPU of the controller 111 judges whether the detachable unit U is brought out from the image forming apparatus 1 or not. If the CPU judges the detachable unit U to be brought out from the image forming apparatus 1 (step S10: YES), the processing transit to step S1.

In step S11, the CPU of the controller 111 changes the guidance display, which is displayed on the LCD 122, to display work items of maintenances to be executed in the detachable unit U that is brought out from the image forming apparatus 1 (step S11). Then, the user executes maintenance according to the guidance display. For example, the user executes exchanging of parts or cleaning or the like, after a disassembly operation such as taking off the wiring installed in several spots inside the detachable unit U. Then, the user build up the detachable unit U by executing reverse procedure to the disassembly operation so as to set the connection section 16 of the detachable unit U to the connection section 10, after a work operation such as an exchanging of parts or a cleaning.

Then, after the CPU detects a detection signal input from the attach/detach detecting section 145 through the mechanical control section 141, the detection signal being indicate a loading of the detachable unit U into the image forming apparatus 1, that is the detection of the detachable unit U being reset to the image forming apparatus 1 (step S12: YES), the processing transit to step S13.

In step S13, the CPU of the controller 111 changes the guidance display, which is displayed on the LCD 122, to display an instruction to operate the lever L to be turned back (step S13). Then, the CPU of the controller 111 judges whether the operation to turn back the lever L is executed or not, according to a detection signal detected from the lever operation detecting section 144 through the mechanical control section 141 (step S14). If the CPU of the controller 111 judges that the lever L is operated to be turned back (step S14: YES), the processing transit to step S15.

In step S15, the CPU outputs an instruction to supply an electric power to the detachable unit U through the mechanical control section 141 to the energization controller 143, and the power supply to the electric parts is started again. Then, the connection judging section 146 of the mechanical control section 141 judges whether the electric components P of the detachable unit U is electrically connected with the power source DC13 or not (step S16). If the CPU judges the electric component P is not electrically connected with the power source DC13 (step S16: NO), the processing transit to step S17.

In step S17, an alarm, which inform the user of the fact that the electric component P is not electrically connected with the power source DC13 (e.g. an alarm massage such as "the electric component P is not connected with" or an illustration of pertinent section) is displayed on the LCD 122 (step S17). Then, the CPU outputs an instruction to block off the power supply to the electric component P, through the mechanical control section 141, to the energization controller 143. The power supply to the electric component P is then blocked off by the energization controller 143 (step S18). Then, a guidance display of appropriate work starts to be displayed on the LCD 122 (step S19). Here, a guidance of appropriate work means, specifically, a guidance that indicates work items for handling the electric component P to be electrically connected with the power source DC13.

Firstly, an instruction to bring out the detachable unit U, by operating the lever L, from the image forming apparatus 1 is displayed on the LCD 122 (step S20). Then, the CPU judges whether the lever L is operated or not, according to whether a detection signal of the rotating operation is input from the lever operation detecting section 144 through the mechanical control section 141 or not (step S21). If the CPU judges that the lever L is not operated (step S21: NO), the processing transit back to step S20. If the CPU judges that the lever L is operated (step S21: YES), the CPU judges whether the detachable unit U is brought out from the image forming apparatus or not, according to a detection signal input from the attach/detach detecting section 145 through the mechanical control section 141. If the CPU judges that the detachable unit U is brought out from the image forming apparatus 1 (step S22: YES), the processing transit to step S23.

In step S23, the CPU changes the guidance display, which is displayed on the LCD 122, to display work items of appropriate work to be executed in the detachable unit U that is brought out from the image forming apparatus 1 (step S23). For example, a work sequence that instruct connecting the connection section 16 of the electric component P into the connection section 10, or the like, is displayed. The user executes the appropriate work in accordance with the appropriate guidance display. Then, the user reset the detachable unit to original location, after the work is finished.

If the CPU detects that the detachable unit U is set into the image forming apparatus 1, according to a detection signal input from the attach/detach detecting section 145 through the mechanical control section 141 (step S24: YES), the processing transit to step S25.

In step S25, the CPU changes the guidance display, which is displayed on the LCD 122, to display an instruction to turn back the lever L to the original location (step S25). Then, the CPU judges whether the operation to turn back the lever L to the predetermined position is executed or not, according to a detection signal input from the lever operation detecting section 144 through the mechanical control section 141 (step S26), the detecting signal being detected when the lever L is rotationally operated at a predetermined angle. If the CPU judges that the operation to turn back the lever L to the predetermined position is executed (step S26: YES), the processing transit back to step S15.

Meanwhile, in step S16, if the CPU judges that the electric component P is electrically connected with the power source DC13 (step S16: YES), the CPU changes the guidance display, which is displayed on the LCD 122, to display an instruction to close the front covers (step S27). If the detecting signal of the interlock switches SW12 being switched ON, which indicates that the front covers are closed, is input from the open/close detecting section 142 through the mechanical control section 141 (step S28: YES), the CPU judges that the set of maintenance work is finished, and display an information of finishing the work (step S29). Then, the selection screen for selecting next operation mode of the image forming apparatus is displayed on the LCD 122 (step S30).

Here, the operation mode to be transited after the maintenance varies with the kind of maintenance. For example, there are maintenances, which can transit to the normal image forming operation mode, which need to be transited to an adjustment mode to be adjusted, or which need to be transited to a counter-resetting mode to reset a counter. Some mode selection buttons are displayed on the selection screen that is displayed on the LCD 122 at step S30, each of the mode selection buttons are corresponding to each of the plurality of the operation modes, respectively. Therefore, a user can select an operation mode corresponding to the maintenance concluded by an operator of the image forming apparatus 1.

Then, if an operation mode is selected through the selection screen displayed on the LCD 122 (step S31: YES), the CPU transit the operation mode of the image forming apparatus 1 to a selected mode (step S32), and finish the processing.

Figure 5:
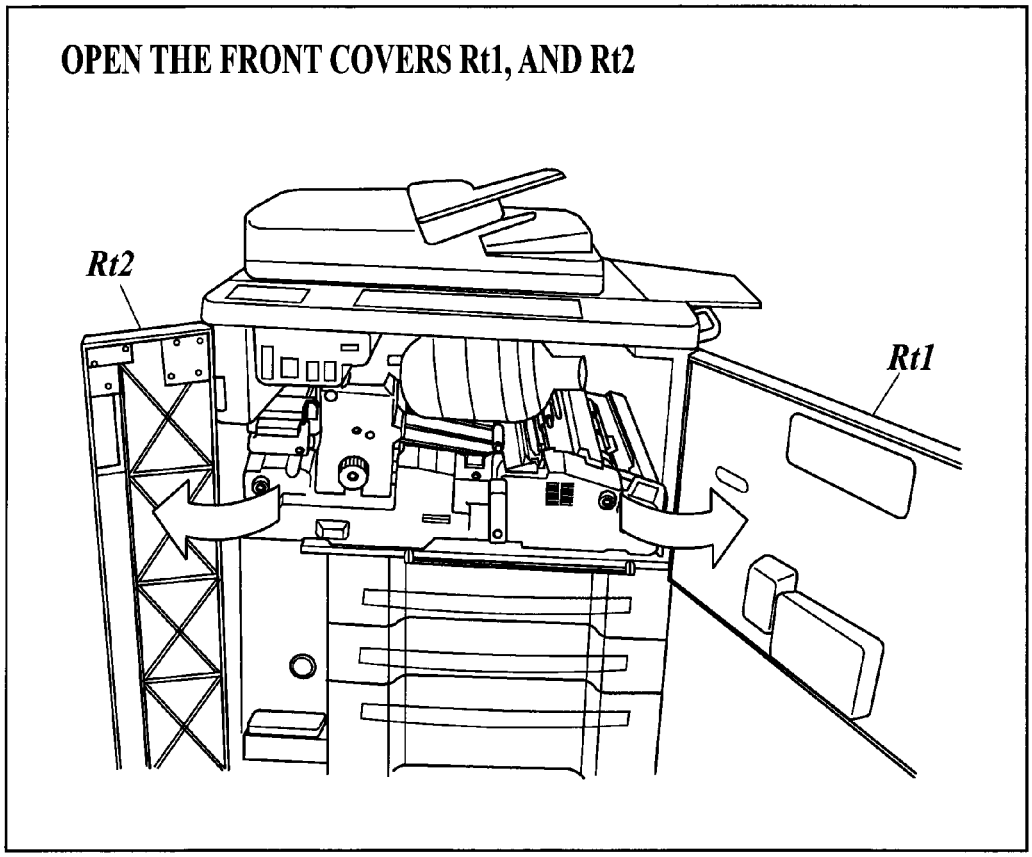
FIG. 5 is a view showing guidance display displayed on an LCD shown in FIG. 2 in the maintenance mode processing shown in FIG. 3.

FIGS. 5-10 shows an example of the set of guidance displayed on the LCD 122 in the above maintenance mode processing. An exemplary case of exchanging register clutch inside the ADU unit is shown in FIG. 5.

FIG. 5 shows an example of the screen that is displayed in step S5. In step S5, as shown in FIG. 5, massages such as, for example, "OPEN THE FRONT COVERS Rt1, AND Rt2" or the like, and an operation to open the front covers Rt1 and Rt2, are displayed by an illustration.

Figure 6:
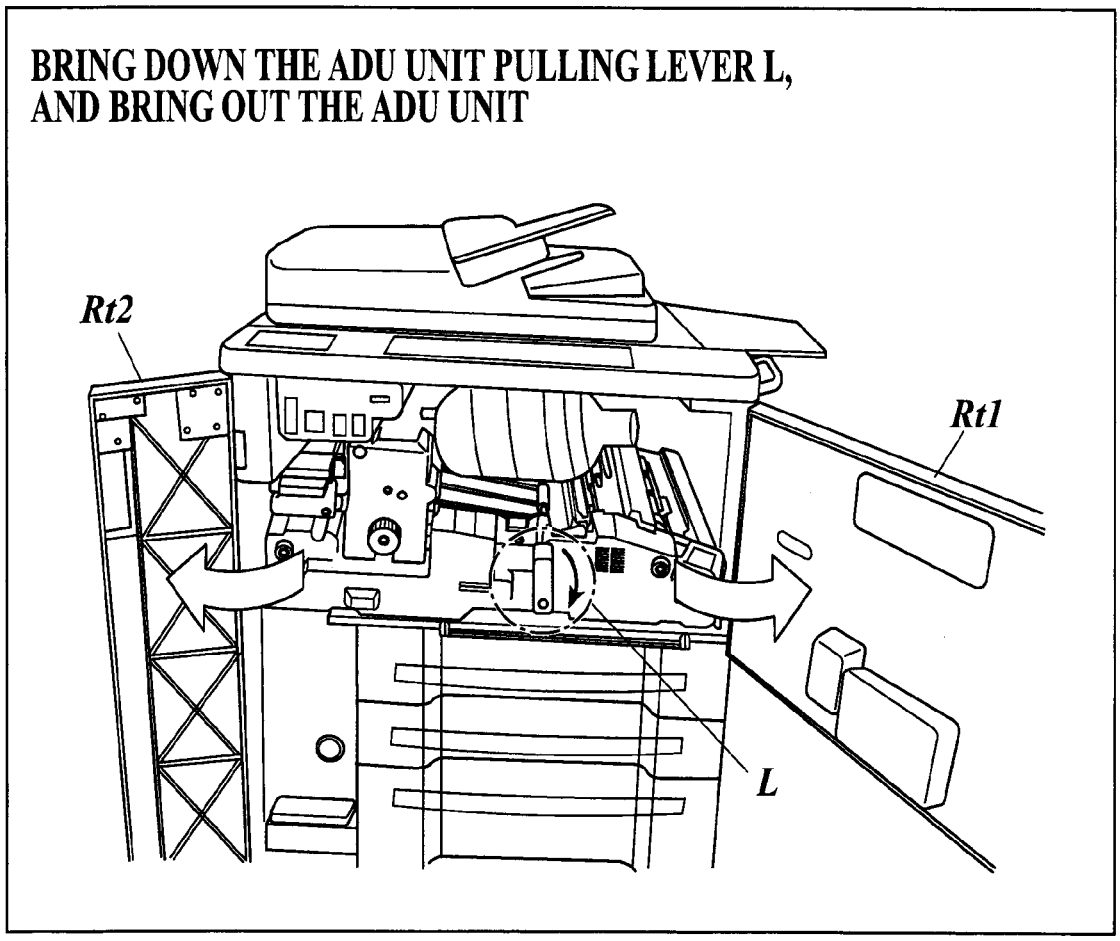
FIG. 6 is a view showing guidance display displayed on an LCD shown in FIG. 2 at step S5 in the maintenance mode processing shown in FIG. 3.

FIG. 6 shows an example of the screen that is displayed in step S7. In step S7, as shown in FIG. 6, massages such as, for example, "BRING DOWN THE ADU UNIT PULLING LEVER L, AND BRING OUT THE ADU UNIT" or the like, and an operation to bring down the lever L, are displayed by an illustration.

FIGS. 7-10 shows an example of the screen that is displayed in step S11. In step S11, as shown in FIGS. 7-10, a work sequences to be executed after taking off the ADU unit as a detachable unit U is displayed by a character and an illustration. Each of the screens may be changed over in series at a predetermined time interval, or may be changed corresponding to a pressing of the "NEXT" button displayed in each screen. After displaying the screens shown in FIGS. 7-10, an assembling procedure for assembling the ADU unit, the procedures being reverse to the disassembly procedures, is displayed.

Figure 7:
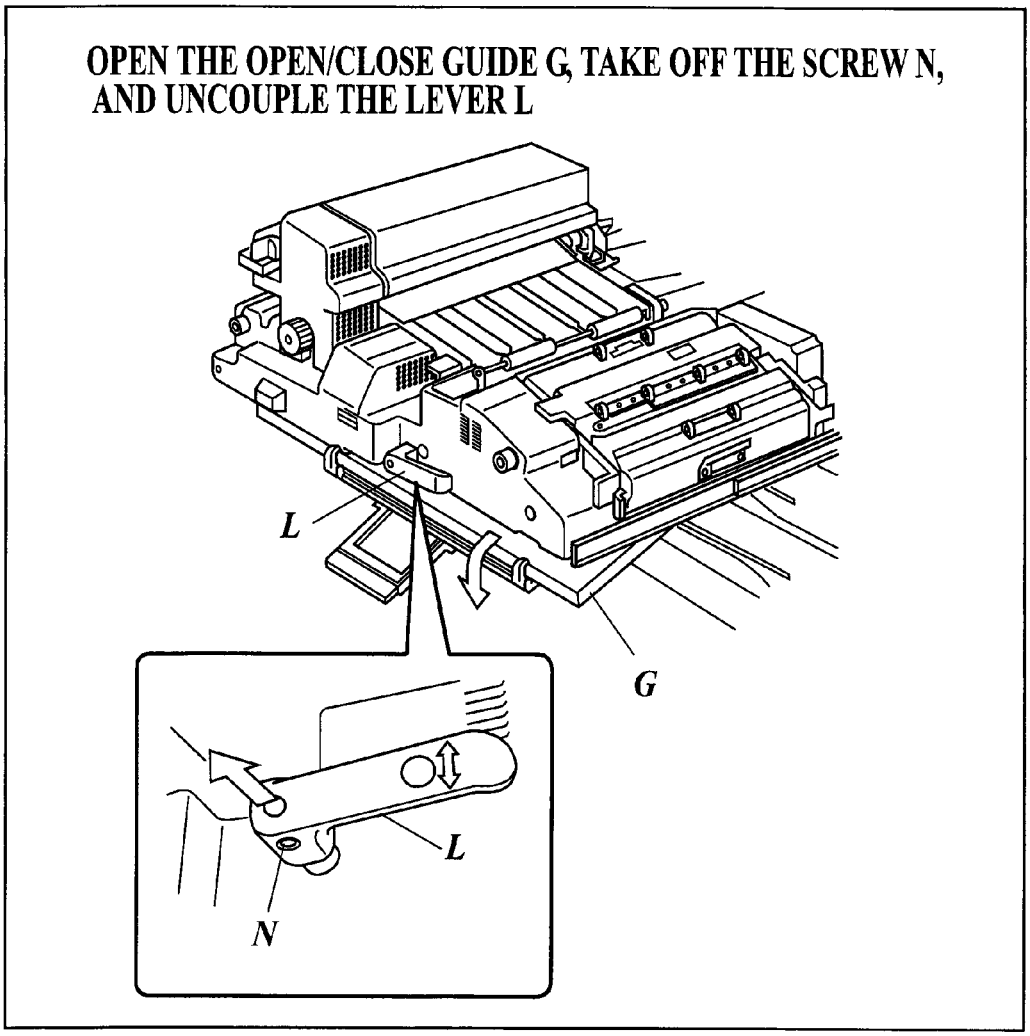
FIG. 7 is a view showing guidance display displayed on an LCD shown in FIG. 2 at step S7 in the maintenance mode processing shown in FIG. 3.
Figure 8:
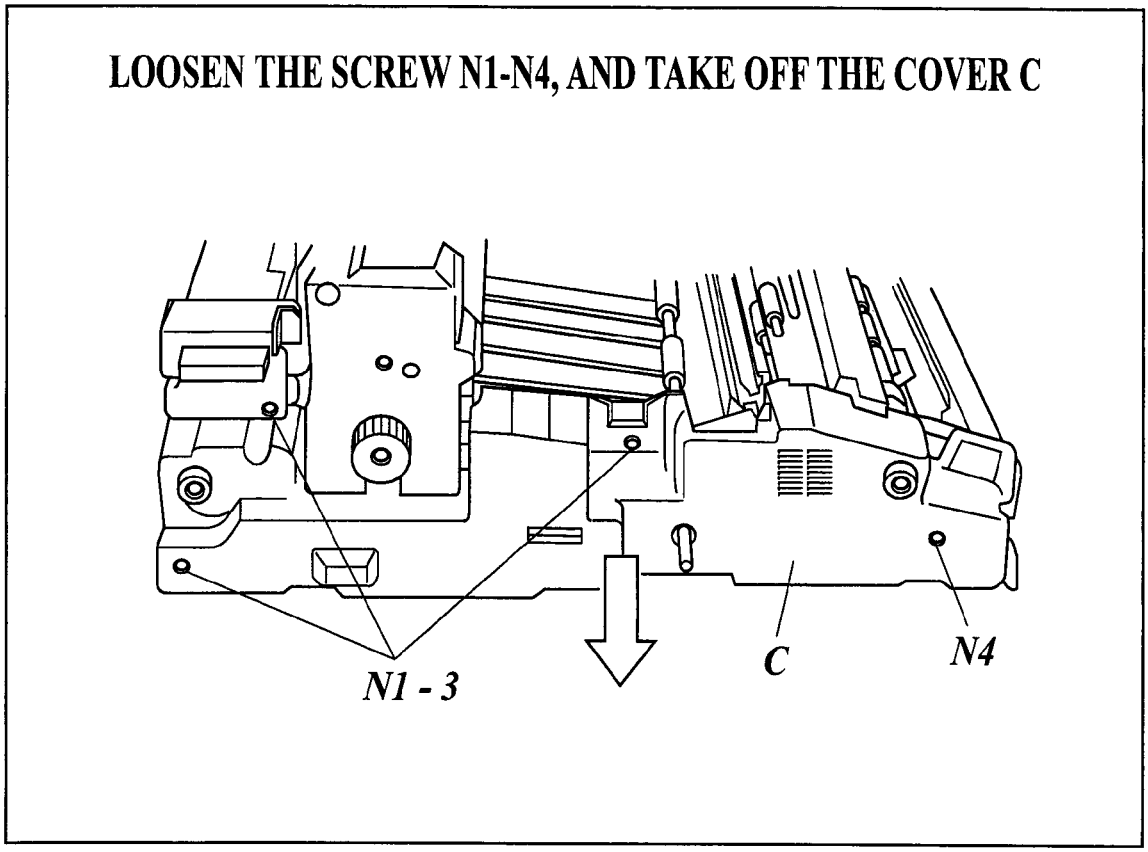
FIG. 8 is a view showing guidance display displayed on an LCD shown in FIG. 2 at step S11 in the maintenance mode processing shown in FIG. 3.
Figure 9:
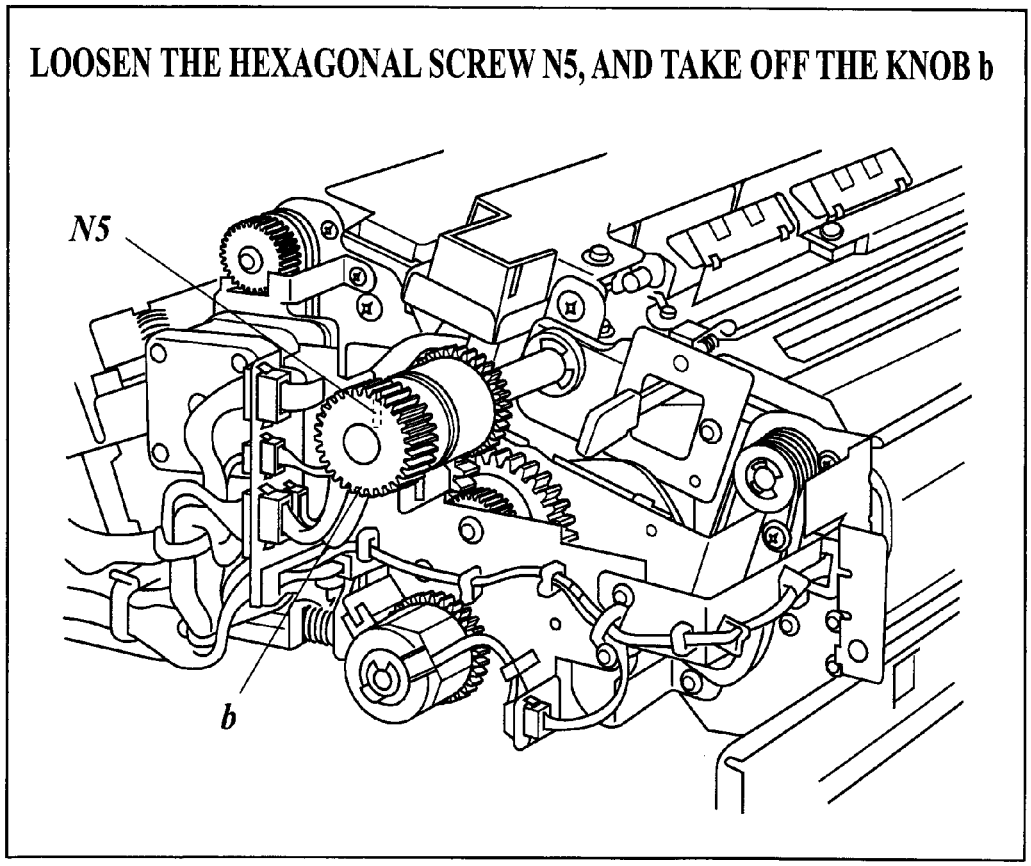
FIG. 9 is a view showing guidance display displayed on an LCD shown in FIG. 2 at step S11 in the maintenance mode processing shown in FIG. 3.
Figure 10:
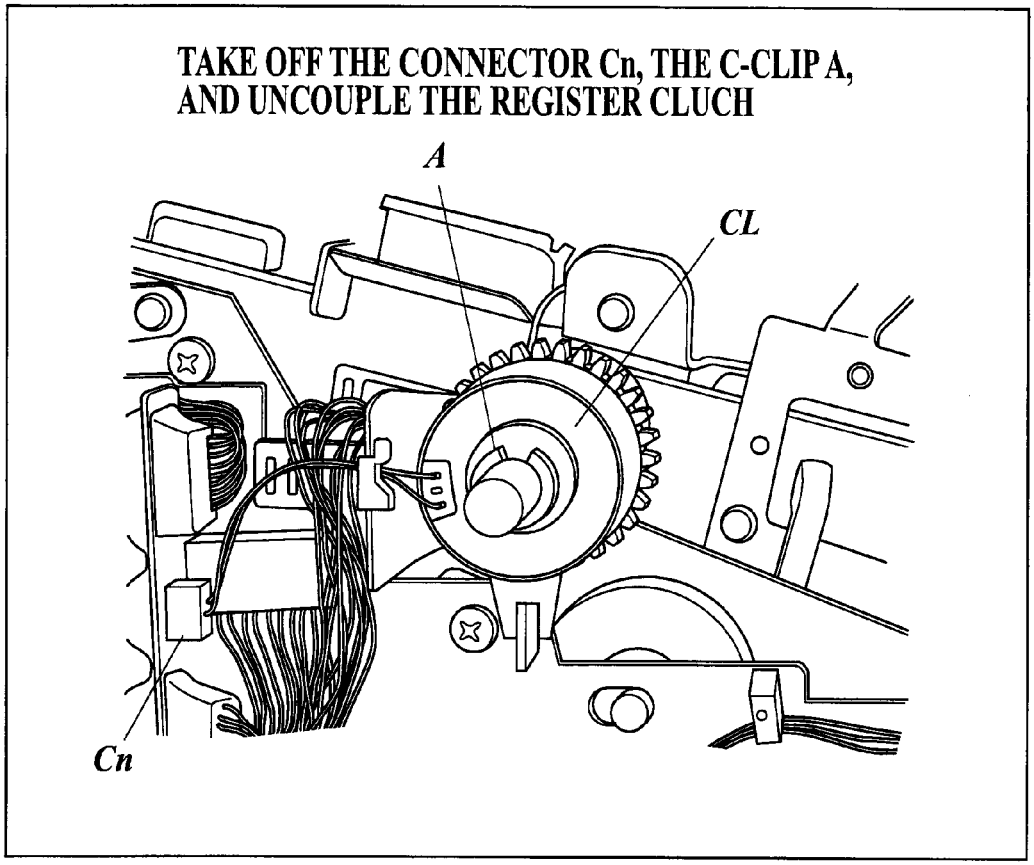
FIG. 10 is a view showing guidance display displayed on an LCD shown in FIG. 2 at step S11 in the maintenance mode processing shown in FIG. 3.

Incidentally, in changing the register clutch of the ADU unit, the screen displayed in step S20 is the same as shown in FIG. 6, and the screen displayed in step S23 is the same as a procedure for inserting a connector Cn shown in FIG. 7, FIG. 8, and FIG. 10, a procedure for assembling the ADU unit, and the like.

As described above, according to the image forming apparatus 1 of the first embodiment, a kind of maintenance is assigned through an operating section 12. Then, if the transition to the maintenance mode is instructed, through the operating section 12, by the user, the controller 111 starts displaying the guidance display of work items for maintenance on the LCD 122. The controller 111 judges the progress of the maintenance work, according to the detecting signals input from the open/close detecting section 142, the lever operation detecting section 144, the attach/detach detecting section 145 and so on, through the mechanical control section 141. The controller 111 changes the display of work items for maintenance, block off the power supply to the electric component P of the detachable unit U that is to be maintained, according to the progress of the maintenance work. Then, when the power supply to the detachable unit U is resumed after blocking off the power supply to the detachable unit U, the controller 111 judges whether the electric component P is electrically connected with the power source DC13 or not. If the electric component P is not electrically connected with the power source DC13, the controller 111 displays a guidance display of corresponding work items on the LCD 122.

Therefore, since the guidance that corresponds to the progress of maintenance work is automatically displayed on the LCD 122, even those operators who have little knowledge, experience, skills of maintenance, such as an average users, can perform an operation easily, and certainly, in accordance with the guidance. Moreover, since the power supply to the first electric component P to be maintained or to the second electric component adjacent to the first electric component P is automatically blocked off in accordance with the progress of the maintenance work, the safeness of an operator can be ensured and a breakage of the image forming apparatus 1 can be prevented. Moreover, a work burden of an operator to switch ON/OFF the power supply can be reduced. Furthermore, an alarm and a guidance of corresponding works are displayed on the LCD 122 in case that the electric component P is not connected with the power source DC13, when the detachable unit U is reset to the image forming apparatus 1 and the power supply to the electric component P is restarted, after an exchange of parts or a cleaning. Therefore, in case that there is some cause that prevents the image forming apparatus 1 from returning normally from a recess, the operators can understand the cause and corresponding works, that enables a downtime caused by the maintenance work to be reduced.

Modified example of the first embodiment will be described hereinbelow.

In the first embodiment, an example of the present invention applied to maintaining the image forming apparatus 1 is described. However, the present invention may be applied to, for example, maintaining an image forming system having the image forming apparatus 1 and the sheet finisher 2 built onto the image forming apparatus 1, wherein the system functions according to a control of the controller 111.

In this case, the sheet finisher 2 includes the detachable unit U, as well as the printer 40 includes the same. Moreover, the sheet finisher 2 includes a mechanical control unit, which is similar in construction to the mechanical control unit 14 shown in FIG. 2, the mechanical control unit 14 being connected with the controller 111 of the total controlling unit 11 by a serial communication or the like. Moreover, the sheet finisher 2 includes connection sections for connecting a detachable unit U of the sheet finisher 2 to a mechanical control section of the sheet finisher 2. The coupling structure between the connection section and the detachable unit U is the same as that of the connection section 10 shown in FIG. 2.

When an instruction for maintaining components inside the sheet finisher 2 is input from the operation section 12, the controller 111 controls, by the same operation shown in FIG. 3, the guidance display of work items and/or power supply to an electric component P of the detachable unit U, according to various detection signals input from a mechanical control unit mounted in the sheet finisher 2. Moreover, the controller 111 displays a guidance display of corresponding work, in case that the electric component P of the detachable unit U is not electrically connected with the power source DC13 after the detachable unit U is reset to the sheet finisher 2.

According to the above described modified example of the first embodiment, an operator can perform a complicated maintenance work safely and certainly not only in maintaining the printer 40 of the image forming apparatus 1 but also in maintaining the sheet finisher 2, in the image forming system.

Next, a second embodiment of the present invention will be described.

The second embodiment shows an example of the present invention applied to a sheet finisher 2A. Incidentally, the mechanical construction of the sheet finisher 2A will be omitted since the construction is the same as that of the sheet finisher 2 shown in FIG. 1.

Figure 11:
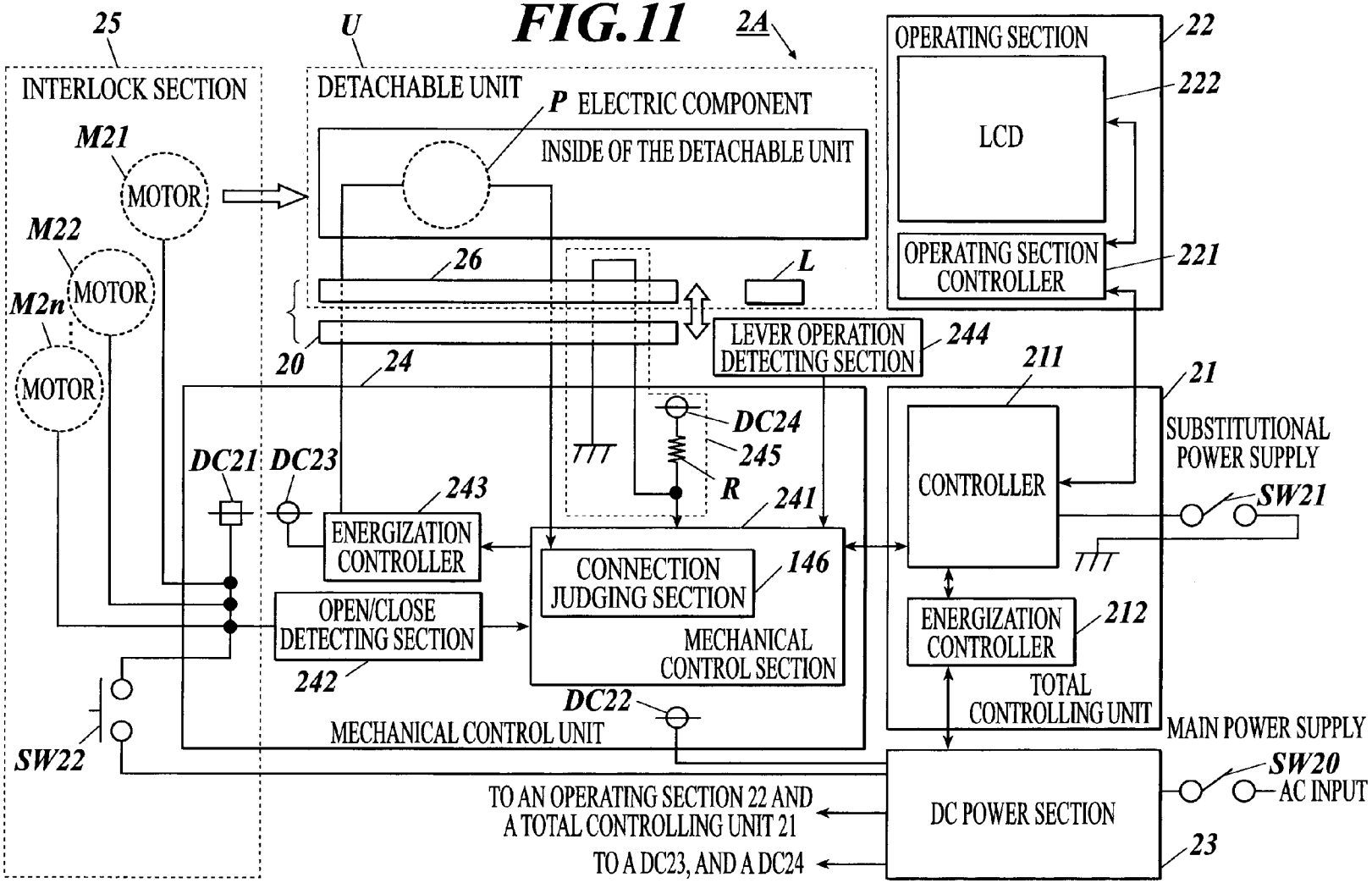
FIG. 11 is a block diagram showing a construction of a control system of the sheet finisher of a second embodiment of the present invention.

FIG. 11 shows an example of the control system of the independent sheet finisher 2A.

An each block factors shown in FIG. 11 will be omitted since each of them is the same as that of the block factors of same name shown in FIG. 2, though the prefix number of the each numerals assigned to each block factors, respectively, are exchanged from "1" to "2". In this embodiment, the detachable unit U means, for example, the starching section 66 shown in FIG. 1, or the like.

In the sheet finisher 2A, if a kind of maintenance is selected, and an instruction to transit to a maintenance mode is input from the operating section 22, the CPU of the controller 211 execute the same processing as the maintenance mode processing shown in FIG. 3, that is executed by a software processing that is performed by the CPU in cooperation with a maintenance mode processing program stored in a ROM of the controller 211.

That is, the controller 211 starts to display a guidance display of the work items of maintenance on the LCD 222, and judges the progress of the maintenance operation, according to a detection result input from the open/close detecting section 242, lever operation detecting section 244, attach/detach detecting section 245 or the like, through the mechanical control section 241. Then, the controller 211 changes over the guidance display according to the progress of the operation, and blocks off the power supply to the electric component P of the detachable unit U to be maintained. If the power supply to the electric component P is restarted after blocking the power supply, the controller 211 judges whether the electric component P is electrically connected with the power source DC23 or not. Then, the controller 211 displays guidance display of corresponding work on the LCD 222 if the electric component P is not connected with the power supply DC23.

As described above, according to the sheet finisher 2A of the second embodiment, since the guidance that corresponds to the progress of maintenance work is automatically displayed on the LCD 222, even those operators who have little knowledge, experience, skills of maintenance, such as an average users, can perform an operation easily, and certainly, in accordance with the guidance. Moreover, since the power supply to the first electric component P to be maintained or to the second electric component adjacent to the first electric component P is automatically blocked off in accordance with the progress of the maintenance work, the operators safety can be ensured and a breakage of the image forming apparatus 1 can be prevented. Moreover, a work burden of an operator to switch ON/OFF the power supply can be reduced. Furthermore, an alarm and a guidance of corresponding works are displayed on the LCD 222 in case that the electric component P is not connected with the power source DC23, when the detachable unit U is reset to the image forming apparatus 1 and the power supply to the electric component P is restarted, after an exchange of parts or a cleaning. Therefore, in case that there is some cause that prevents the sheet finisher 2A from returning normally from a recess, the operators can understand the cause and corresponding works, that enables a downtime caused by the maintenance work to be reduced.

Although the first and second exemplary embodiments of the present invention have been shown and described, the invention is not limited to the embodiments shown. That is, for example, the guidance display of work items for maintaining the image forming apparatus 1 may be displayed on the display of the sheet finisher 2. Moreover, the construction detail and detail operation of the image forming apparatus 1, of the sheet finisher 2, and of the sheet finisher 2A, may be modified arbitrarily, within the scope of this invention.

The entire disclosure of Japanese Patent Application No. 2007-183219 filed on Jul. 12, 2007 including description, claims, drawings and summary are incorporated herein by reference in its entirely.

Although various exemplary embodiments have been shown and described, the invention is not limited to the embodiments shown. Therefore, the scope of the invention is intended to be limited solely by the scope of the claims that follow.

What is claimed is:

1. An image forming apparatus, comprising:

a display for displaying a work item for a maintenance in the form of a guidance display;

a detection section for detecting whether the work item currently displayed on the display is executed or not;

an energization controller for supplying/blocking power supply to a first electric component to be maintained and/or to a second electric component being located adjacent to the first electric component;

a connection judging section for judging whether the first/second electric components are electrically connected with the power supply or not; and a controller for controlling the display to switch displays of the work item and for controlling the energization controller to switch supplying/blocking power supply to the first/second electric component in accordance with a detection result of the detection section;

wherein the controller causes the display to display an alarm and a guidance display of a corresponding work, when the connection judging section judges the electric components not being electrically connected with the power supply, when the power supply is resumed after blocking the power supply to the first/second electric component by the energization controller.

2. The image forming apparatus according to claim 1, wherein each of the first/second electric components is unitized, and the unit is detachably attached to a housing of the image forming apparatus, to another unit, or to the electric component through a connection section.

3. A sheet finisher, comprising:

a display for displaying a work item for a maintenance in the form of a guidance display;

a detection section for detecting whether the work item currently displayed on the display is executed or not;

an energization controller for supplying/blocking power supply to a first electric component to be maintained and/or to a second electric component being located adjacent to the first electric component;

a connection judging section for judging whether the first/second electric components are electrically connected with the power supply or not; and a controller for controlling the display to switch displays of the work item and for controlling the energization controller to switch supplying/blocking power supply to the first/second electric component in accordance with a detection result of the detection section;

wherein the controller causes the display to display an alarm and a guidance display of a corresponding work, when the connection judging section judges the electric components not being electrically connected with the power supply, when the power supply is resumed after blocking the power supply to the first/second electric component by the energization controller.

4. The sheet finisher according to claim 3, wherein each of the first/second electric components is unitized, and the unit is detachably attached to a housing of the sheet finisher, to another unit, or to the electric component through a connection section.

5. An image forming system having an image forming apparatus and a sheet finisher, the system comprising:

a display for displaying a work item for a maintenance in the form of a guidance display;

a detection section for detecting whether the work item currently displayed on the display is executed or not;

an energization controller for supplying/blocking power supply to a first electric component to be maintained and/or to a second electric component being located adjacent to the first electric component;

a connection judging section for judging whether the first/second electric components are electrically connected with the power supply or not; and a controller for controlling the display to switch displays of the work item and for controlling the energization controller to switch supplying/blocking power supply to the first/second electric component in accordance with a detection result of the detection section;

wherein the controller causes the display to display an alarm and a guidance display of a corresponding work, when the connection judging section judges the electric components not being electrically connected with the power supply, when the power supply is resumed after blocking the power supply to the first/second electric component by the energization controller.

6. The image forming system according to claim 5, wherein each of the first/second electric component is unitized, and the unit is detachably attached to a housing of the image forming system, to another unit, or to the electric component through a connection section.

* * * * *